United States Patent [19]

McCormick

[11] Patent Number: 4,792,314

[45] Date of Patent: Dec. 20, 1988

[54] MARINE DRIVE WITH FLOATING SPIDER DIFFERENTIAL ASSEMBLY

[75] Inventor: Daniel F. McCormick, Oshkosh, Wis.

[73] Assignee: Brunswick Corporation, Skokie, Ill.

[21] Appl. No.: 160,811

[22] Filed: Feb. 26, 1988

[51] Int. Cl.[4] ..... B63H 5/10

[52] U.S. Cl. ..... 440/81; 74/665 K; 416/129

[58] Field of Search ..... 440/75, 80, 81, 82; 416/128, 129 R, 129 A; 74/665 K, 665 EB, 713

[56] References Cited

U.S. PATENT DOCUMENTS

| | | | |
|---|---|---|---|
| 2,067,023 | 1/1937 | Schleicher | 74/665 K |
| 2,229,153 | 1/1941 | Ware | 74/389 |
| 2,392,015 | 1/1946 | Wart | 74/665 K |
| 2,886,985 | 5/1959 | Meyer | 74/780 |
| 4,540,369 | 9/1985 | Caires | 440/81 |
| 4,543,854 | 10/1985 | Roth | 74/710 |

*Primary Examiner*—Sherman D. Basinger

*Attorney, Agent, or Firm*—Andrus, Sceales, Starke & Sawall

[57] ABSTRACT

A spider differential assembly (7) of a marine drive is constructed so that the spider (16) and its associated spider pinion gears (20) can float in all directions, except about the common central axis (5) of the propeller drive shafts (4, 8). More particularly, a spider is provided with a central hub opening (18) through which the main drive shaft passes. A plurality of radially extending spindles (19) carry the spider gears and extend outwardly where they terminate in an enclosure (30, 31) arranged to prevent circumferential spider movement about the common drive shaft axis, but which permits free spider floating.

7 Claims, 2 Drawing Sheets

MARINE DRIVE WITH FLOATING SPIDER DIFFERENTIAL ASSEMBLY

BACKGROUND AND SUMMARY OF THE INVENTION

This invention relates to a marine drive with a spider differential assembly, and more particularly to such an assembly for use in a dual propeller drive.

Previously known devices of the type under consideration here provide dual propellers for driving a boat through the water. The propellers have normally been of reversed configuration, but otherwise identical, and have been rotatable about a common axis and disposed closely adjacent each other. Using two propellers reduces vibration, increases thrust, and essentially eliminates reverse torque effective from the drive on the boat.

Examples of such known drives are disclosed in U.S. Pat. Nos. 2,229,153 and 4,540,369.

The prior known drives have required that the parts involved be machined with a high degree of precision, which makes them costly to manufacture.

It is an object of the present invention to provide a dual propeller marine drive differential assembly wherein a number of the parts thereof need not be machined to extremely close tolerances, and yet the torque between the spider gears of the assembly is accurately divided.

In accordance with the various aspects of the invention, a spider differential assembly of a marine drive is constructed so that the spider and its associated spider pinion gears can float in all directions, except about the common central axis of the propeller drive shafts. More particularly, a spider is provided with a central hub opening through which the main drive shaft passes. A plurality of radially extending spindles carry the spider gears and extend outwardly where they terminate in an enclosure arranged to prevent circumferential spider movement about the common drive shaft axis, but which permits free spider floating.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
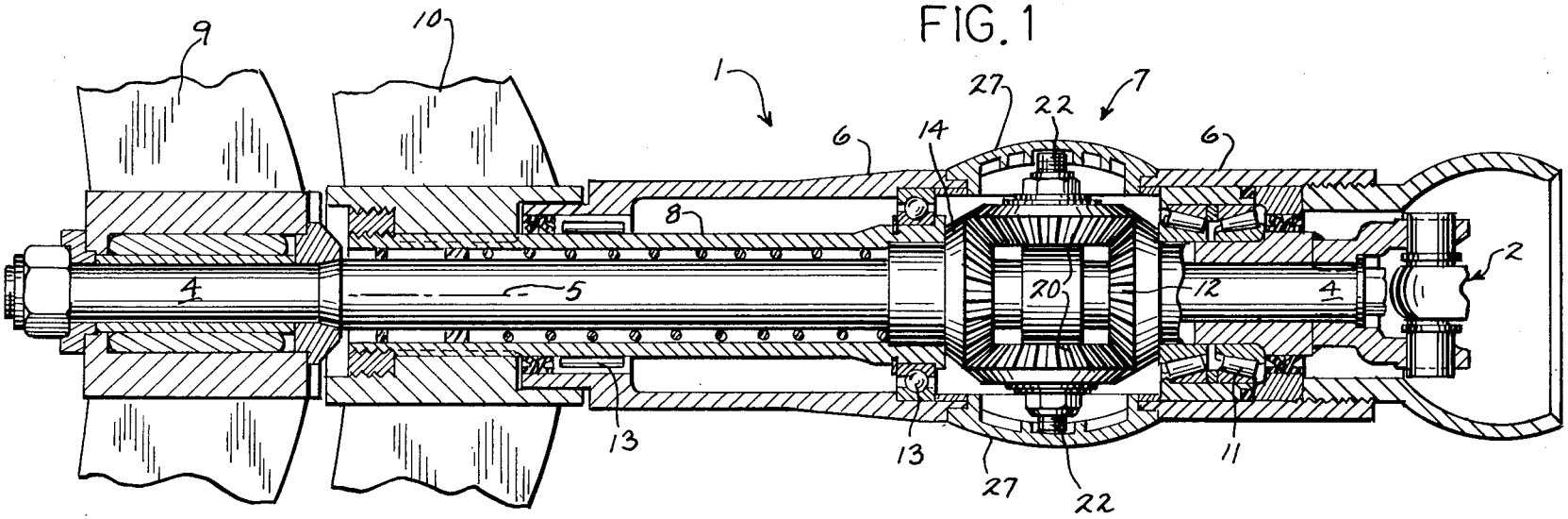
FIG. 1 is a longitudinal generally sectional view of a marine drive incorporating the various aspects of the present invention.

As shown in the drawings, a marine drive 1 is provided and which is adapted to be connected to a suitable engine or the like, not shown. The engine's drive output, designated at 2, is connected to an annular sleeve 3 which is keyed or otherwise fixedly secured to the inner end portion of a main shaft 4 which extends through drive 1 and is adapted to rotate about a central longitudinal axis 5. A longitudinal housing 6 encloses shaft 4 throughout a major portion of the latter's extent.

Drive 1 includes a differential assembly 7, to be described more fully hereinafter, which is disposed intermediate the ends of shaft 4 and through which the shaft passes. A secondary shaft 8 is of tubular construction and telescopes over main shaft 4 outwardly of assembly 7, and is mounted for separate rotation relative thereto on axis 5. A first propeller 9 is suitably fixed to the outer end portion of main shaft 4 for rotation therewith, while a second propeller 10 is suitably fixed to the outer end portion of secondary shaft 8. Propellers 9 and 10 are basically mirror images of each other and are adapted to be driven in respective reverse directions for efficiently propelling a vehicle through the water.

In the embodiment shown, sleeve 3 is journalled in annular bearings 11 within housing 6 and is provided with an input side bevel gear 12 fixed thereon. Likewise, secondary shaft 8 is also journalled in bearings 13 within housing 6 and is provided with an output side bevel gear 14 fixed thereon and spaced from gear 12. Bevel gears 12 and 14 are adapted to cooperate with a spider assembly 15 disposed therebetween. For this purpose, a spider 16 includes a central hub 17 having a central opening 18 therein. A plurality of spindles 19 extend radially outwardly from hub 17, two such spindles being utilized in the present embodiment. Each spindle 19 carries a beveled pinion or spider gear 20 which is mounted to the respective spindle through an annular bearing assembly 21, with each spider gear meshing with both side bevel gears 12 and 14, in the usual manner.

Each spindle 19 is provided with an outer tip portion 22 which is disposed outwardly of the walls of housing 6. Furthermore, a threaded portion 23 on spindle 19 receives a tightening nut 24 which engages and secures its respective bearing assembly 21 against a shoulder 25 on spider 16 to hold the bearing assembly in place.

Figure 4:
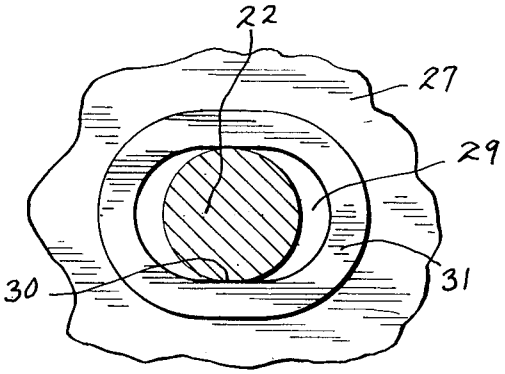
FIG. 4 is an enlarged view of the spindle confining enclosure taken on line 4—4 of FIG. 2.
Figure 2:
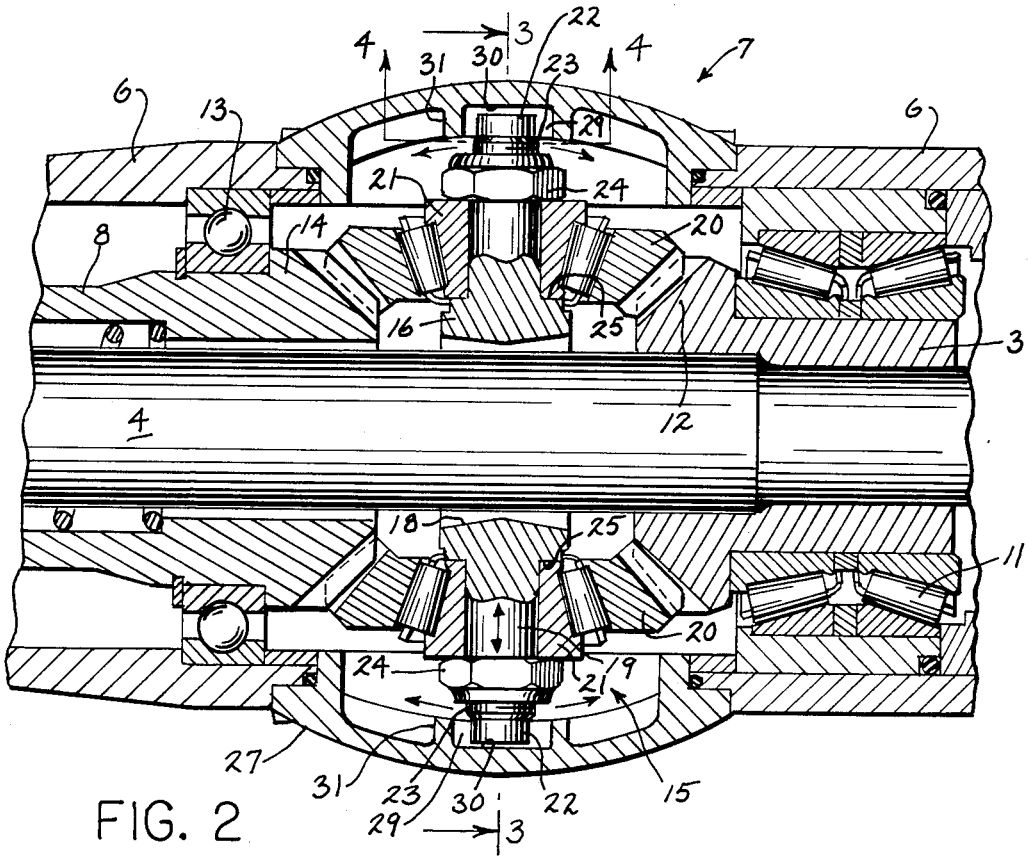
FIG. 2 is an enlarged sectional view of the differential assembly.
Figure 3:
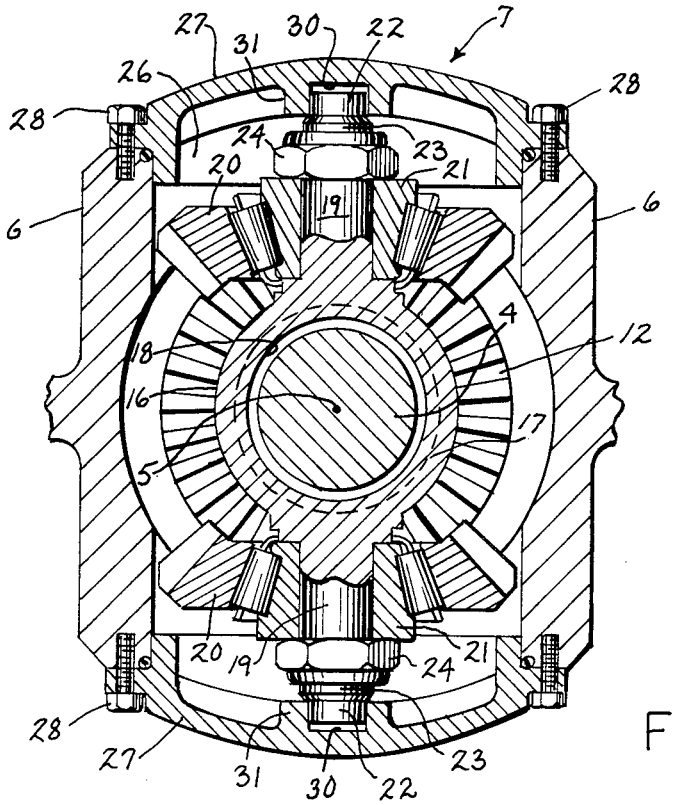
FIG. 3 is a central vertical section of the differential assembly taken on line 3—3 of FIG. 2.

In accordance with the various aspects of the invention, means are provided to permit spider assembly 15 with its associated parts to float within its mounting so that the assembly can shift in virtually all directions except about central axis 5. For this purpose, an access opening 26 is provided in housing 6 adjacent each spindle 19, and through which the respective spindle extends. A domed cap 27 is secured to housing 6 as by bolts 28, and forms a housing portion which normally closes the opening. A radially inwardly extending spider-tip-receiving enclosure pocket 29 is formed centrally of cap 27, with pocket 29 being delineated by a floor 30 formed by the cap wall, and an inwardly extending peripheral wall 31. Pocket 29 is of slightly greater length than width, as best shown in FIG. 4. Furthermore, the pocket extends lengthwise generally parallel to axis 5, and widthwise generally transverse to the axis. The relative dimensions of spindle tips 22 and pockets 29 are such that the tips fit closely against and are confined by the elongated longitudinal portions of walls 31, but are spaced from the wall ends as well as from pocket floors 30.

The construction is such that spider assembly 15 is floatingly free about shaft 4, with spindle tips 22 sliding along the longitudinal extent of pocket 29. Likewise, in the event of vibrations occurring in main shaft 4, or if the shaft or spider is off-center, assembly 15 is floatingly free to shift transversely of axis 5 due to the spaces provided between spindle tips 22 and pocket floors 30.

It is not desirable to have spider assembly 15 rotate about axis 5. Such movement is prevented by the restraining close fit between spindle tips 22 and the elongated wall portions of pocket 29.

Various modes of carrying out the invention are contemplated as being within the scope of the following claims particularly pointing out and distinctly claiming the subject matter which is regarded as the invention.

I claim:

1. In a dual propeller marine drive, the combination comprising:

(a) a drive housing (6), (b) a pair of shafts (4, 8) rotatable about a common axis (5), (c) said shafts having respective input and output bevel gears (12, 14) thereon, (d) a transversely extending spider (16) disposed between said bevel gears and with said spider including:

(1) a central body portion forming a hub (17) which has a walled opening (18) receiving one of said shafts (4) therethrough, (2) and a plurality of spindles (19) extending radially outwardly from said hub and with said spindles terminating in tip portions (22) and carrying spider gears (20) meshing with said bevel gears, (e) and mounting means (29, 25) for mounting said spider for free floating movement so that said spider is pivotable in a direction longitudinally of said axis and is shiftable transversely of said axis.

2. The dual propeller marine drive of claim 1 in which said mounting means includes:

(a) pocket means (29) associated with said housing (6) and with said pocket means receiving said spindle tip portions (22), and (b) said pocket means being elongated and respectively permitting longitudinal movement of said tip portions therein.

3. The dual propeller marine drive of claim 1 in which said mounting means includes:

(a) pocket means (29) associated with said housing (6) and with said pocket means receiving said spindle tip portions (22), (b) said pocket means having floor means (30) spaced from the ends of said spindle tip portions so that said spider is free to shift transversely of said axis.

4. In a dual propeller marine drive, the combination comprising:

(a) a drive housing (6), (b) a pair of shafts (4, 8) rotatable about a common axis (5), (c) said shafts having respective input and output bevel gears (12, 14) thereon, (d) a transversely extending spider (16) disposed between said bevel gears and with said spider including:

(1) a central body portion forming a hub (17) which has a walled opening (18) receiving one of said shafts (4) therethrough, (2) and a plurality of spindles (19) extending radially outwardly from said hub and with said spindles terminating in tip portions (22) and carrying spider gears (20) meshing with said bevel gears, (e) and mounting means (29, 25) for mounting said spider for free floating movement so that said spider is pivotable in a direction longitudinally of said axis and is shiftable transversely of said axis, said mounting means including:

(1) pocket means (29) associated with said housing (6) and with said pocket means receiving said spindle tip portions (22), (2) said pocket means being elongated and respectively permitting longitudinal movement of said tip portions therein, (3) said pocket means having floor means (30) spaced from the ends of said spindle tip portions so that said spider is free to shift transversely of said axis.

5. The dual propeller marine drive of claim 1, which includes: means (31) restraining said spider (16) from rotating about said axis (5).

6. The dual propeller marine drive of claim 5 in which said spider restraining means includes:

(a) pocket means (29) associated with said housing (6) and with said pocket means receiving said spindle tip portions (22), (b) said pocket means including longitudinally extending wall means which closely confine said tip portions.

7. The dual propeller marine drive of claims 2, 3 or 4 wherein said pocket means (29) is formed by longitudinally extending wall means which closely confine said tip portions (22) to thereby form means (31) restraining said spider (16) from rotating about said axis (5).

* * * * *